United States Patent [19]

Rowland

[11] 4,045,173

[45] Aug. 30, 1977

[54] TEXTILES FLAME RETARDED WITH HYDROXYMETHYLPHOSPHORUS COMPOUNDS IN COMBINATION WITH POLY(ETHYLENEUREAS) AND POLY(N-METHYLOLETHYLENEUREAS)

[75] Inventor: Stanley P. Rowland, New Orleans, La.

[73] Assignee: The United States of America as represented by the Secretary of Agriculture, Washington, D.C.

[21] Appl. No.: 633,069

[22] Filed: Nov. 18, 1975

[51] Int. Cl.[2] ..... D06M 13/30

[52] U.S. Cl. ..... 8/116 P; 8/195; 427/381; 427/390 D

[58] Field of Search ..... 8/116 P, 195, 185; 427/278, 390 D

[56] References Cited

U.S. PATENT DOCUMENTS

| | | | |
|---|---|---|---|
| 3,421,923 | 1/1969 | Guth | 428/278 |
| 3,671,304 | 6/1972 | Mischutin | 427/390 D |
| 3,878,245 | 4/1975 | Nachbur | 260/2 P |

OTHER PUBLICATIONS

Marsh, J. T., *Crease Resisting Fabrics,* Reinhold, N.Y. 1962, pp. 64–67.

*Primary Examiner*—Paul R. Michl
*Attorney, Agent, or Firm*—M. Howard Silverstein; David G. McConnell; Salvador J. Cangemi

[57] ABSTRACT

Hydroxymethylphosphorus compounds are insolubilized in and reacted with cellulosic textiles by combination with poly(ethyleneureas) and poly(N-methylolethyleneureas) to impart durable flame retardancy to the textile. The poly(ethyleneurea) or poly(N-methylolethyleneurea) may be employed as the sole coreactant for the hydroxymethyl phosphorus compound or as a supplement to urea, N-methylolureas, and the like.

2 Claims, No Drawings

TEXTILES FLAME RETARDED WITH HYDROXYMETHYLPHOSPHORUS COMPOUNDS IN COMBINATION WITH POLY(ETHYLENEUREAS) AND POLY(N-METHYLOLETHYLENEUREAS)

This invention relates to flame retardant fibrous cellulosic materials containing phosphorus and nitrogen atoms and to a process for their production. More particularly, this invention relates to flame retardant textile finishes and a process of employing them for flameproofing textiles. The textile is impregnated with an aqueous solution consisting of a monomeric phosphorus-containing reagent and an oligomeric or polymeric nitrogen-containing reagent and is then cured to render the textile flame retardant.

The term textile designates a fabric, filament, staple, yarn, or products made therefrom.

There are various methods known for flameproofing textiles, which include the application of tetrakis(hydroxymethyl)phosphonium chloride (Thpc), Thpc neutralized with sodium hydroxide to a pH of 7.0–7.5 (THPOH), and tris(hydroxymethyl)phosphine (THP). In the various processes employing Thpc, THPOH, or THP, the coreagents, with which the phosphorus-containing monomers react, have been monomeric reagents such as ammonia, urea, N-methylol urea, N-methylolmelamine, and the like.

We have discovered that nitrogen-containing compounds which are oligomeric or polymeric in nature may be employed advantageously in reaction with Thpc and THPOH for the fixation of phosphorus and nitrogen in cellulosic fibers. The oligomeric or polymeric nitrogen-containing reagents are poly(ethyleneureas) or a poly(N-methylolethyleneureas).

The combustibility of organic fibrous substrates treated with these phosphorus and nitrogen containing reagents is lower than those of the original organic fibers and the groups responsible for the lowered combustibility are durably fixed in or attached to the organic fibers by relatively strong bonds.

It is therefore an object of the present invention to make available flame retardant finishes which can be used effectively and advantageously on cotton textiles, but also on other cellulosic substrates such as rayon textiles, paper sheets, and nonwoven fabrics based on cellulosic fibers.

It is a further object of the invention to make available textile finishes which are durable to washing and drycleaning.

It is still another object of the present invention to provide textile finishes which contribute durable-press properties as well as flame retardant characteristics to cellulosic substrates, primarily cellulosic and cellulosic blend textiles, while retaining strength, abrasion resistance, whiteness, and other desirable properties characteristic of the original cellulosic substrate.

According to the present invention, there is provided a process for flameproofing cellulose-containing textiles with a finish which can be cured under mild conditions or conventional conditions, which is durable to washing and drycleaning, which provides effective flame retardancy, which contributes durable-press characteristics to the textiles, and which contributes significantly to strength and abrasion properties.

It is commonly characteristic of textile finishes that phosphorus and nitrogen-containing compounds for development of flame retardancy and for the development of durable-press properties have deleterious effects upon performance characteristics such as breaking strength, tearing strength, and abrasion resistance.

This invention is based on the discovery that oligomeric or polymeric poly(ethyleneureas) and poly(N-methyloethyleneureas) are especially useful nitrogen-containing reagents for coreaction with, and fixation of Thpc, THPOH, and THP in cellulosic substrates. The poly(ethyleneureas) or poly(N-methylolethyleneureas) may be used as the sole coreactants with Thpc, THPOH, and THP or they may be used in conjunction with conventional monomeric fixing agents, such as ammonia, urea, N-methylolureas, and trimethylolmelamine. The oligomeric or polymeric nitrogen-containing reagents may be prepared by reaction of urea with a polyamine at elevated temperature. For example, three moles of urea may be reacted with one mole of triethylenetetraamine at 100° with the evolution of nitrogen. The reaction may be conducted in the presence or absence of water. Similarly, urea may be reacted with polyethylenimine at 100°, with or without the presence of water. The molecular weight of the poly(ethyleneurea) depends upon the molecular weight of the polyamine or polyimine, and these molecular weights may vary from that of triethylenetetramine (molecular weight = 146) to that of a polyethylenimine of molecular weight 100,000 or higher. Reaction of urea with the polyamine or polyimine raises the molecular weight in proportion to the ratio of moles of urea to nitrogen atoms of the polyamine or polyimine. At maximum, the molecular weight may be about doubled by this reaction. The poly(N-methylolethyleneureas) may be prepared by the base-catalyzed reaction of formaldehyde with the poly(ethyleneureas) in aqueous solution. These reaction are conveniently conducted in aqueous solution with adjustment of the pH to a range of 9–11 by addition of base. In most cases, however, the poly(ethylenureas) are sufficiently basic to provide self-catalysis for the methylolation reaction. The poly(ethyleneureas) and poly(N-methylolethyleneureas) may be employed directly as prepared or may be adjusted to a lower pH prior to combination with phosphorus-containing reagents.

The basic characteristics of the poly(ethyleneureas) and poly(N-methylolethyleneureas) are generally beneficial for their buffering action in the reaction mixture and in the reaction that occurs in and on the fibrous substrate.

The monomeric phosphorus-containing reagents employed for reaction with the foregoing nitrogen-containing oligomeric and polymeric reagents are Thpc, THPOH, and THP.

Reactions of monomeric phosphorus-containing reagents with the oligomeric or polymeric nitrogen-containing reagents may be conducted in a variety of ways. An adduct or coreaction product may be produced from the two different types of reagents prior to application to the textile or cellulosic substrate. On the other hand, the phosphorus-containing reagent and the nitrogen-containing reagent may be combined in aqueous solution and applied to the substrate. Additionally, one reagent may be applied from solution prior to application of the other reagent. In all cases, it is desirable to dry the substrate and allow opportunity for the reagents to coreact within the cellulosic substrate. The coreaction is commonly facilitated by the introduction of catalysts, elevation of temperature, exposure to ammonia, or a combination of these.

Catalysts are not generally necessary for conducting the reaction between phosphorus-containing reagent and nitrogen-containing reagent of this invention, but, in some cases, advantage is obtained from the addition of material such as di-sodium hydrogen phosphate, magnesium chloride, lactic acid, aluminum chlorhydroxide, and the like. In some cases it is desirable to maintain the initial pH of the reagent system from about 6 to about 8.

The finishing formulations of this invention may contain other ingredients of the type per se known in the textile finishing art, for example, water and soil repellents, optical brighteners and colorants, softening agents, hand-modifying agents, buffering agents, and pH-adjusting agents which may be acids or bases.

The process of this invention can be used to reduce the combustibility of substantially any fibrous organic material such as cotton, rayon, ramie, jute, wool, paper, cardboard, and mixtures of these with noncellulosic fibers which can be impregnated with a liquid and dried and cured. Where textile structures are being treated in accordance with this invention, the structure may be composed of a mixture of various fibers. The polymers produced in or on fibrous textile structures are more effective in reducing the combustibility of those products which consist only of cellulosic fibers. When noncellulosic fibers are present, best results are obtained when the structure contains 50% or more cellulosic fibers, except when the noncellulosic fiber is itself flame resistant. Textile materials can be treated in the form of fiber, sliver, yarn, or fabric.

Where a textile is being impregnated, it is of advantage to remove the excess reagent by passing the textile through squeeze rolls adjusted to apply a comparatively high pressure prior to drying and curing the impregnated textile. It is also of advantage to dry the textile to remove a substantial amount of water prior to the curing reaction. The drying operation may be conducted in a temperature range of 50°–100° C prior to a curing reaction at a higher temperature. However, complete cure may occur during the drying reaction when a high level of catalysis is employed. Generally, however, the curing reaction is conducted at temperatures ranging from 120° C to about 180° C for periods ranging from 30 seconds to 10 minutes.

The degree of flameproofing imparted to a textile or cellulosic substrate by the products of this invention can be varied from a low degree at a very high degree by control of the amount of polymer impregnated and cured into the substrate. Textiles treated in accordance with this invention are flame resistant and they are also glow resistant, shrink resistant, mildew resistant, and rot resistant in proportion to the extent of the treatment. The treated textiles may also exhibit durable-press performance properties together with retention of high levels of strength and abrasion resistance. The effects of these treatments are permanent, and resistant to laundering, drycleaning, and alkali and acid extractions.

The following examples illustrate but do not limit the scope of this invention.

EXAMPLE 1

Polyethylenimine having a molecular weight ranging from about 225 to 375 was reacted with urea in aqueous solution at 100° C until the elimination of ammonia was substantially complete. In this case 120 parts of urea, 86 parts of polyethylenimine, and 150 parts of water were employed for the reaction. After completion of the reaction, the solids concentration was adjusted to 50%. The combination of reagents for application to cotton fabrics was prepared by dissolving 296 parts of Thpc (80% concentration), 226 parts of the poly(ethyleneurea) (50% concentration), and 40 parts of disodium hydrogen phosphate in 478 parts of water. The pH was 6.0 Cotton printcloth was immersed in this solution and passed through squeeze rolls to obtain a wet pickup of approximately 115%. The fabric was dried for five minutes at 85° C and cured for two minutes at 160° C. After thorough washing in hot water, the fabric was dried and found to have an add-on of 26.5%. The color of the fabric was unchanged from that of the original printcloth. It passed the match test of Reeves, McMillan, and Guthrie (Text. Res. J. 23 (8), 527 [1953]) at 135°. In this test, if a strip of fabric does not burn in the vertical position when ignited at the bottom, it is said to pass at 180° C (high flame retardance). If the flame goes out when the strip is held horizontally, it passes at 90° C (moderate flame retardance). If the flame goes out when held vertically with the flame at the top, it passes at 0° (slight flame retardance). The durable-press rating of the fabric was 2.8 compared to 1.0 for the initial printcloth, showing substantial improvement.

EXAMPLE 2

A solution was prepared from 313 parts of Thpc (80% concentration), 39 parts of urea, 121 parts of poly(ethyleneurea), 40 parts of disodium hydrogen phosphate, and 527 parts of water. Cotton printcloth was padded into this solution and through aqueeze rolls to obtain a wet pickup of about 120%. The fabric was dried for 5 minutes at 85° C and cured for 5 minutes at 150° C. It was washed thoroughly in hot water, air dried, and weighed. The add-on of reagent was 27% and the durable-press rating was 2.6. The fabric passed the match test at 180°. The flame retardancy was maintained through multiple launderings and through multiple extractions with drycleaning solvents.

EXAMPLE 3

A solution was prepared containing the following reagents: 191 parts of Thpc (80%), 430 parts of poly(N-methylolethyleneurea) (46% concentration), one part of wetting agent, and 374 parts of water. The poly(N-methylolethyleneurea) was prepared by methylolation of poly(ethyleneurea) having a molecular weight in the range of about 650–950. The pH was 6.5. Cotton fabric was padded through the reagent solution two times, dried for 5 minutes at 85° C and cured for 5 minutes at 150° C. The fabric was washed thoroughly in hot water, air dried, and weighed. The add-on of reagent was 31%. The fabric showed no discoloration and passed the match test at about 90°. It had a durable-press rating of 3.6.

EXAMPLE 4

A solution was prepared from 185 parts of Thpc (80solution), 58 parts of urea, 90 parts of trimethylomelamine, 108 parts of poly(ethyleneurea) (50% concentration) of molecular weight range of about 450–750, one part of wetting agent, and 560 parts of water. Cotton fabric was immersed in this solution, put through squeeze rolls, reimmersed, resqueezed, dried for 5 minutes at 85° C, and cured for 5 minutes at 150° C. The fabric was washed thoroughly in hot water, air dried, and weighed. The add-on of polymer developed in the fabric was 33.5%. It passed the match test at 180°.

The durable press rating of the fabric was 3.8. The finish was durable to multiple launderings.

EXAMPLE 5

A reagent solution was prepared as follows: 24 parts of Thpc (80%), 7.5 parts of urea, 18 parts of poly(N-methylolethylenurea) (46% solution) having a molecular weight in the range of about 650–950, a trace of wetting agent, and 50.5 parts of water were agitated to make a homogenous solution. Cotton fabric was padded twice through this solution, dried for 5 minutes at 85° C, and cured for five minutes at 150° C. The thoroughly washed fabric was air dried and weighed. The add-on of polymer fixed within the fabric was 22%. The match test value was about 20°. The fabric had a durable press rating of 2.5 compared to the original fabric rating of 0.9.

EXAMPLE 6

A reagent solution was prepared to contain 320 parts of Thpc (80%), 66 parts of poly(ethyleneurea) (50% concentration) of molecular weight approximately 500–800, and 280 parts of water. This solution was refluxed for 30 minutes. To this solution was added a trace of wetting agent and 343 parts of a 5% solution of ammonium acetate. Cotton fabric was padded to this solution twice to obtain a wet pickup of about 110%. The fabric was dried in an oven for 4 minutes at 80° C and then exposed to ammonia vapors for 1.5 minutes. At this point the fabric was immersed in solution of dilute ammonium hydroxide for 1.5 minutes. Subsequently, the fabric was rinsed in cold water and then washed thoroughly in hot water for 15 minutes. The air dried fabric showed an add-on of 20% of durably fixed reagents. The durable-press rating was 2.5. The fabric was slow to ignite and burst into flame when held vertically over a match but the flame was not sustained when the fabric was tilted to an angle of approximately 135°.

EXAMPLE 7

A reagent solution was prepared to contain 304 parts of THPOH (70.5%), 295 parts of poly(N-methylolethylenurea) (46%) having a molecular weight in the range of 650–950, a trace of wetting agent, and 401 parts of water. Cotton fabric was padded through the reagent solution to obtain a wet pickup of approximately 100%. The fabric was dried to about 15% moisture content at 80° C and then exposed to ammonia gas for approximately 6 minutes. Thereafter, it was subjected to a cure for five minutes at 150° C. The add-on of polymeric reagents deposited in the cotton fabric was 21.6%. When the exposure to ammonia was eliminated, the add-on of reagents to the cotton fabric was 24.4%. The former fabric showed a match test angle of 125° and the latter fabric a match test angle of 160°.

EXAMPLE 8

Cotton fabric was padded twice through a solution of reagents prepared to contain 229 parts of THPOH (73% concentration), 465 parts of poly(N-methylolethylenurea) (46%) of molecular weight about 700–1000, a trace of wetting agent and 306 parts of water. The fabric was dried for 4 minutes at 85° C and cured for 4 minutes at 150° C. It was washed in hot water, air dried, and weighed, and evaluated. The add-on of polymeric reagents was approximately 32%. The durable-press rating was 3.6. The match test angle was 135°.

EXAMPLE 9

Cotton fabric was padded twice through a solution of the solvent composition: 221 parts of THPOH (of 70.5% concentration), 63 parts of urea, 97 parts of trimethylolmelamine, and 117 parts of poly(ethyleneurea) (50%) of molecular weight range 450–750, a trace of wetting agent, and 502 parts of water. The padded fabric was dried for 4 minutes at 85° C and cured for 4 minutes at 150° C. It was washed in hot water and air dried. The add-on of reagents was 34%, the match test angle was 180°, and the durable-press rating was 3.4.

EXAMPLE 10

Reagent solution A was prepared to contain 385 parts of THPOH (70.5%), 281 parts of poly(N-methylolethylenurea) (46%) of molecular weight range about 700–1000, and 224 parts of water. Solution B was prepared to contain nine parts of lactic acid, one part of aluminum chlorohydroxide, one part of wetting agent, and 424 parts of water. These solutions were combined, mixed thoroughly, and employed for impregnation of fabric. Cotton fabric was padded twice through this solution to about 110° wet pickup, dried at 85° for three minutes and cured at 160° for 3 minutes. The fabric was washed in hot water for 20 minutes and then air dried. The add-on was 32%. The match angle was 180°. The durable press rating on the fabric was 2.2. High levels of strength and abrasion resistance were retained.

EXAMPLE 11

A reagent solution was prepared to contain the following components: 37.2 parts of THPOH (73%), 14.5 parts of poly(ethyleneurea) (50%) of molecular weight about 450–750, 5.2 parts of trimethylolmelamine, 0.9 parts of lactic acid, 0.1 part of aluminum chlorhydroxide, and water to make the total up to 100 parts. Fabric padded twice through this solution was dried for 3 minutes at 85° and cured for 3 minutes at 160° C. It was washed thoroughly in hot water for 20 minutes and air dired. The add-on was 24%. The match test angle was 135°. The durable press rating of the fabric was 2.2. In comparison to a sample of fabric treated with a reagent solution like that above but with 8 parts of urea and 5.8 parts of trimethylolmelamine replacing the poly(ethyleneurea) and trimethylolmelamine, the samples of fabric described in Example 10 and this example exhibited about 20% better retention of tearing strength and about 15% better retention of Stoll flex abrasion resistance.

EXAMPLE 12

Poly(N-methylolethyleneureas) were prepared by methylolation of poly(ethyleneureas) that were made by reactions of urea with polyethylenimines having molecular weights about as follows: (a) 400–800, (b) 1600–2000, (c) 40,000–60,000, and (d) 50,000–100,000. Reagent solution No. 1 was prepared to contain 234 parts of Thpc (80% concentration), 34 parts of triethanolamine, 33 parts of polyethylene softener (30% concentration), 107 parts of trimethylolmelamine, 111 parts of urea, and 831 parts of water. Additional reagent solutions were made up with reduction of the triethanolamine to 30 parts and reduction of trimethylolmelamine to 97 parts and with introduction of 10 parts of solids of poly(N-methylolethyleneurea) from above. The amount of water was adjusted to maintain the same concentration of total reagents in all cases. Reagent solutions involving *a, b, c,* and *d* were numbered 2, 3, 4, and 5, respectively. Cotton sheeting was padded to about 100% wet pickup in these reagent solutions, dried at 85° C for 5 minutes, and cured at 160° C for 3 minutes. Samples were washed thoroughly and air-dried. The add-ons were slightly higher (23–24%) for treatments 2, 3, 4, and 5 than for No. 1 (22.5%); char lengths in the vertical flame test were slightly lower for 2, 3, 4, and 5 (2.1–2.9 in.) than for No. 1 (3.7 in.); durable press ratings were similar; breaking strengths were slightly higher for all treated fabrics; tearing strengths were below those of the unmodified fabric, ranging from −22% for No. 1 to −16 to −10% for Nos. 2, 3, 4, & 5; Accelerator abrasion resistance measurements showed that the treated fabrics lost more weight than the unmodified cotton and that the retentions of weight (relative to the unmodified cotton) were higher for Nos. 4 and 5 (95-96%) and Nos. 2 and 3 (93%) than for No. 1 (90.5%).

We claim:

1. A process for imparting durable flame retardancy to textiles comprising:

a. impregnating a textile fabric in an aqueous solution containing a nitrogeneous compound selected from the group consisting of a poly(ethyleneurea) made by reacting urea with a polyamine from the class of polyethylenamine or polyethyleneimine and a poly(N-methylolethyleneurea) made by the methylolation of the above-mentioned poly(ethyleneurea) and a phosphorus containing compound selected from the group consisting of tetrakis(hydroxymethyl)phosphonium chloride, tetrakis(hydroxymethyl)phosphonium hydroxide and tris(hydroxymethyl)phosphine; and b. drying and curing the impregnated fabric from (a).

2. A process for imparting durable flame regardancy to textiles comprising:

reacting in an aqueous solution a nitrogeneous compound selected from the group consisting of a poly(ethyleneurea) made by reacting urea with a polyamine from the class of polyethyleneamine or polyethyleneimine and a poly(N-methylolethyleneurea) made by the methylolation of the abovementioned poly(ethyleneurea) and a phosphorus containing compound selected from the group consisting of tetrakis(hydroxymethyl)phosphonium chloride, tetrakis(hydroxymethyl)phosphonium hydroxide and tris(hydroxymethyl)phosphine;

b. impregnating a textile fabric in the solution from (a); and c. drying and curing the impregnated fabric from (b).

* * * * *